US005935901A

United States Patent [19]

Shinozaki et al.

[11] Patent Number: 5,935,901

[45] Date of Patent: Aug. 10, 1999

[54] THERMAL TRANSFER RECORDING MATERIAL AND THERMAL TRANSFER RECORDING METHOD USING SAME

[75] Inventors: Kenji Shinozaki; Hideki Hirano; Yukichi Murata; Mio Ishida; Miyuki Kuromiya, all of Kanagawa, Japan

[73] Assignees: Sony Corporation, Tokyo, Japan; Mitsubishi Chemical Corporation, Tokyo, Japan

[21] Appl. No.: 08/614,135

[22] Filed: Mar. 11, 1996

[30] Foreign Application Priority Data

Mar. 10, 1995 [JP] Japan ..... 7-079907
Jul. 26, 1995 [JP] Japan ..... 7-190654

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 5,070,069 12/1991 Bradbury et al. ..... 503/227
5,567,669 10/1996 Harada et al. ..... 503/227
5,602,073 2/1997 Harada ..... 503/227

FOREIGN PATENT DOCUMENTS 0608881 of 0000 European Pat. Off. ..... 503/227
7-89107 of 1995 Japan ..... 503/227

*Primary Examiner*—Bruce H. Hess
*Attorney, Agent, or Firm*—Hill & Simpson

[57] ABSTRACT

A thermal transfer recording material for use in a recording apparatus in which the thermal transfer recording material is introduced into a transfer section having a porous structure by an effect of capillarity, subjected to a state transformation by heating, and then transferred to a recording medium disposed in an opposed relation to the transfer section, comprising:

a dye represented by the general formula (I):

(I)

where $R^1$ and $R^2$ are individually a substituted or unsubstituted alkyl or alkenyl group, or a cycloalkyl group, and when both $R^1$ and $R^2$ are unsubstituted alkyl groups, at least one of $R^1$ and $R^2$ is a branched alkyl group.

12 Claims, 4 Drawing Sheets

THERMAL TRANSFER RECORDING MATERIAL AND THERMAL TRANSFER RECORDING METHOD USING SAME

BACKGROUND OF THE INVENTION

1. Field of the Invention

This invention relates to a novel thermal transfer recording material and a thermal transfer recording method using the recording material, and more particularly to a cyan-color thermal transfer recording material and a thermal transfer recording method for recording an image, for example, a full-colored image, on a recording medium by using the recording material in a liquid state, in which the recording material is splashed or vaporized from a recording (transfer) section of a recording apparatus toward the recording medium such as a printing paper by selectively heating the recording (transfer) section in response to information data.

2. Prior Art

In association with a recent progress of multi-colored image formation in the fields such as video cameras, computer graphics and the like, there is an increasing demand for coloring of hard copies. In order to fulfill the requirements for such a coloring of hard copies, a variety of proposals or attempts have been made, which include, for example, a sublimation-type thermal transfer recording system, a fusion-type thermal transfer recording system, an ink-jet printing system, an electrophotographic recording system, a thermal-development silver salt-type recording system or the like. Among them, the dye diffusion-type thermal transfer recording system (sublimation-type thermal transfer recording system) and the ink-jet printing system have been predominately utilized because of facilitated operations with outputs of high quality image.

In the dye diffusion type thermal transfer recording system, there is used an ink ribbon or an ink sheet on which an ink layer composed of an adequate binder resin and a transfer dye dispersed in the binder resin at a high concentration, is coated. The ink ribbon or sheet is brought, under a constant pressure, into close contact with a recording medium such as a printing paper on which a dyable resin as a dye-acceptor for the transfer dye is coated. The ink ribbon or the ink sheet is then heated by a thermal print head in response to an image date entered so that the dye on the ink ribbon or sheet is caused to be transferred to the recording medium in an amount corresponding to the heat supplied to the ink layer of the ink ribbon or sheet.

The aforementioned transfer operations are repeated with respect to separate image signals for three primary colors of a subtractive process including yellow, magenta and cyan so that full-colored images with continuous tone gradation can be obtained on the recording medium. Particular attention has been paid to such a dye diffusion thermal transfer recording system as an excellent technique because it can achieve compactness of a recording apparatus used, ease of maintenance, prompt printing operation, reproduction of a high quality image approximately identical to those of the silver salt color picture.

FIG. 1 schematically shows a front view of a printer used in such a thermal transfer recording system.

In the printer as shown in FIG. 1, a thermal print head 1 is disposed in an opposed relation to a platen roller 3.

Interposed between the thermal print head 1 and the platen roller 3 is an ink sheet 12 composed of a base film 12*b* and an ink layer 12*a* coated over the base film 12*b*, and a recording paper (recording medium) 20 composed of a substrate paper 20*b* and a dyable resin layer 20*a* coated on the paper 20*b*. The ink sheet 12 and the recording paper 20 are pressed on the thermal print head 1 by the rotating platen roller 3.

The thermal print head 1 selectively heats the ink sheet 12 so that an ink (transfer dye) in the ink layer 12*a* is transferred in a dot pattern on the dyable resin layer 20*a* of the recording paper 20, whereby the thermal transfer recording operation is accomplished. The thermal transfer recording operation can be done in a serial printing mode in which the thermal print head 1 is scanned in a direction perpendicular to a traveling direction of the recording paper 20, or in a line printing mode in which one linear thermal print head 1 is fixedly arranged in a direction perpendicular to traveling direction of the recording paper 20.

However, these recording systems has posed serious problems such as a large amount of wastes and a high running cost due to disposable ink sheets. This results in prohibiting the use of these recording systems in further wide application fields. Such circumstances have been seen not only in the dye diffusion-type thermal transfer recording system (sublimation-type thermal transfer recording system) but also in the fusion-type thermal transfer recording system.

Thus, the conventional thermal transfer recording system has deficiencies such as a high running cost though it gives a high quality image.

Similarly, the thermal development silver salt-type recording system also has deficiencies such as need of exclusive recording papers and a high running cost due to the disposable ink ribbon or sheet and expensive recording apparatus used therefor though it also gives a high quality image.

On the other hand, in the ink-jet printing system, droplets of a recording liquid are splashed or ejected through a nozzle provided in a thermal print head toward a recording paper in response to a supplied image data by using an electrostatic absorbing system, a continuous oscillation system (piezo-system), a thermal system (bubble-jet system) or the like, as disclosed in U.S. Pat. No. 4,723,129, Japanese patent publication No. 5-217 (1993) and so on.

Accordingly, the ink-jet recording system creates almost no wastes and therefore shows a low running cost as compared with the recording systems in which disposable ink ribbons or sheets are used. Recently, the thermal-type ink-jet printing system is widely utilized because it can give full-colored image outputs in a facilitated operation.

However, in the ink-jet printing system, a concentration gradation of the image in each picture cell is difficult to achieve principally. Further, in the ink-jet printing system, it is impossible to reproduce such a high quality image almost identical to a silver salt-type picture as obtained by the dye diffusion-type thermal transfer recording system, for a short period of time.

That is, in the ink-jet printing system, one droplet of the recording ink produces an image in one picture cell so that a concentration gradation of the image in the picture cell is principally unachievable. This prohibits an image formation with a high quality as a whole. Although an attempt has been made to obtain an image with a pseudo-concentration gradation by Dither method based on its high resolution, the ink-jet printing system cannot give a high quality image identical to those obtained by the sublimation-type thermal transfer recording system, and further shows a considerably low image-transfer speed.

To the contrary, the electrophotographic recording system shows a low running cost and a high image transfer speed. However, the electrophotographic recording system requires expensive recording apparatus.

As described above, there exists no conventional recording system which fulfills all the requirements such as a high image quality, a low running cost, inexpensive recording apparatus, a short image transfer time and the like.

Recently, in order to overcome these problems encountered in the conventional recording systems, there has been proposed a novel recording method as is disclosed in Japanese patent application laid-open publication No. 7-89107 (1995) and European patent application laid-open publication No. 0,608,881. The method is called a non-contact type dye-ejection thermal transfer recording system in which a recording liquid is introduced into a transfer section having a porous structure due to capillarity, heated by an adequate heating means such as a laser and formed into a vapor or a mist having a diameter not more than 1 $\mu$m. Such a vapor or mist is transferred through a gap of 10 $\mu$m to 300 $\mu$m on a recording paper disposed in an opposed relation to the transfer section.

In such a thermal transfer recording system, the porous structure gives a large surface area of the heater section (transfer section), and permits a continuous feed of the recording liquid to the transfer section due to its capillarity and sure retention of the recording liquid in the transfer section. The transfer section is then selectively heated with an appropriate quantity of heat corresponding to the image data, by a heating means, for example, a laser beam, whereby a part of the recording liquid is vaporized to form an adequate amount of fine vapor particles or fine droplets. The thus-produced fine vapor particles or fine droplets of the recording liquid can be transferred to the recording medium so that a printed image can be formed thereon in response to image data supplied in the from of an electrical signal from color video cameras or the like.

Accordingly, in the thermal transfer recording system, the recording liquid can be converted into a large number of relatively small droplets as compared with those obtained in the conventional ink-jet printing system. Further, the number of such small droplets produced can be freely controlled by a heat energy applied to the transfer section based on the image data. This permits a multi-valued concentration gradation in the picture cell so that the image (for example, full-colored image) having a quality identical to or higher than that of the silver salt-type recording system can be obtained on the recording paper.

The aforementioned recording system is of a thermal transfer type and therefore retains the previously mentioned features including compactness of a recording apparatus therefor, ease of maintenance, a prompt printing operation, a high quality image, a high concentration gradation, or the like.

However, it has been confirmed that the thermal transfer recording system still has problems to be further improved irrespective of the aforementioned features.

That is, when the thermal transfer recording operation is repeated, burnt deposits such as decomposition products of dyestuffs or the like are generated at the transfer section of the recording apparatus so that a nozzle bore of the recording apparatus is clogged, namely a so-called kogation occurs, which results in fluctuation in splash or ejection characteristic of the recording liquid and therefore is likely to cause deterioration of a recording performance.

SUMMARY OF THE INVENTION

It is therefore an object of the present invention to provide a thermal transfer recording material capable of overcoming the aforementioned problems encountered in the prior art, especially kogation of the recording apparatus while maintaining the features of both a thermal transfer recording system and an ink-jet printing system, realizing an excellent resolution and a high concentration gradation in picture cells, and retaining the recording performance for a long period of time.

It is another object of the present invention to provide a thermal transfer recording method in which the aforementioned recording material is used.

As a result of intense studies and investigations made by the present inventors, it has been found that the aforementioned problems are caused by insufficient heat resistance of the dye used in the thermal transfer recording material, and therefore when the particular dye having a sufficient heat resistance is used, the deficiencies such as kogation is eliminated and a life time of a thermal print head can be considerably prolonged.

In a first aspect of the present invention, there is provided a thermal transfer recording material for use in a recording apparatus in which the thermal transfer recording material is introduced into a transfer section having a porous structure by an effect of capillarity, subjected to a state transformation such as vaporization or droplet formation by heating, and then transferred to a recording medium disposed in an opposed relation to the transfer section, comprising a cyan dye represented by the general formula (I):

(I)

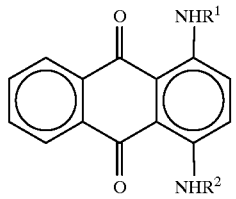

where $R^1$ and $R^2$ are individually a substituted or unsubstituted alkyl or alkenyl group, or a cycloalkyl group, and when both $R^1$ and $R^2$ are unsubstituted alkyl groups, at least one of $R^1$ and $R^2$ is a branched alkyl group.

In a second aspect of the present invention, there is provided a thermal transfer recording method used in operation of a recording apparatus including a transfer section with a porous structure, comprising the steps of:

introducing the thermal transfer recording material containing a dye represented by the general formula (I):

(I)

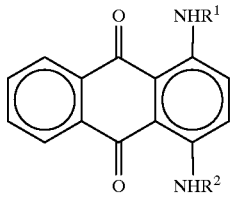

where $R^1$ and $R^2$ are individually a substituted or unsubstituted alkyl or alkenyl group, or a cycloalkyl group, and when both $R^1$ and $R^2$ are unsubstituted alkyl groups, at least one of $R^1$ and $R^2$ is a branched alkyl group into the transfer section by an effect of capillarity;

subjecting the thermal transfer recording material to a state transformation such as vaporization or droplet formation by heating; and transferring the thermal transfer recording material to a recording medium disposed in an opposed relation to the transfer section.

In a third aspect of the present invention, there is provided a thermal transfer recording material for use in a recording apparatus in which the thermal transfer recording material is introduced into a transfer section having a porous structure by an effect of capillarity, subjected to a state transformation such as vaporization or droplet formation by heating, and then transferred to a recording medium disposed in an opposed relation to the transfer section, comprising a cyan dye represented by the general formula (II):

(II)

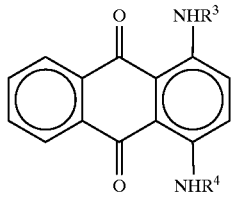

where $R^3$ and $R^4$ are individually a linear alkyl group, and at least one of $R^3$ and $R^4$ is an alkyl group having 5 or more carbon atoms.

In a fourth aspect of the present invention, there is provided a thermal transfer recording method used in operation of a recording apparatus including a transfer section with a porous structure, comprising the steps of:

introducing the thermal transfer recording material containing a dye represented by the general formula (II):

(II)

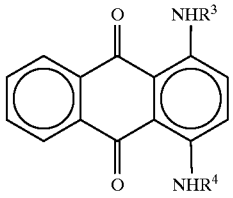

where $R^3$ and $R^4$ are individually a linear alkyl group, and at least one of $R^3$ and $R^4$ is an alkyl group having 5 or more carbon atoms, into the transfer section by an effect of capillarity;

subjecting the thermal transfer recording material to a state transformation such as vaporization or droplet formation by heating; and transferring the thermal transfer recording material to a recording medium disposed in an opposed relation to the transfer section.

These and other objects, features and advantages of the present invention will become more apparent from the following detailed description when read in conjunction with the accompanying drawings and the appended claims.

DETAILED DESCRIPTION OF THE INVENTION

Figure 1:
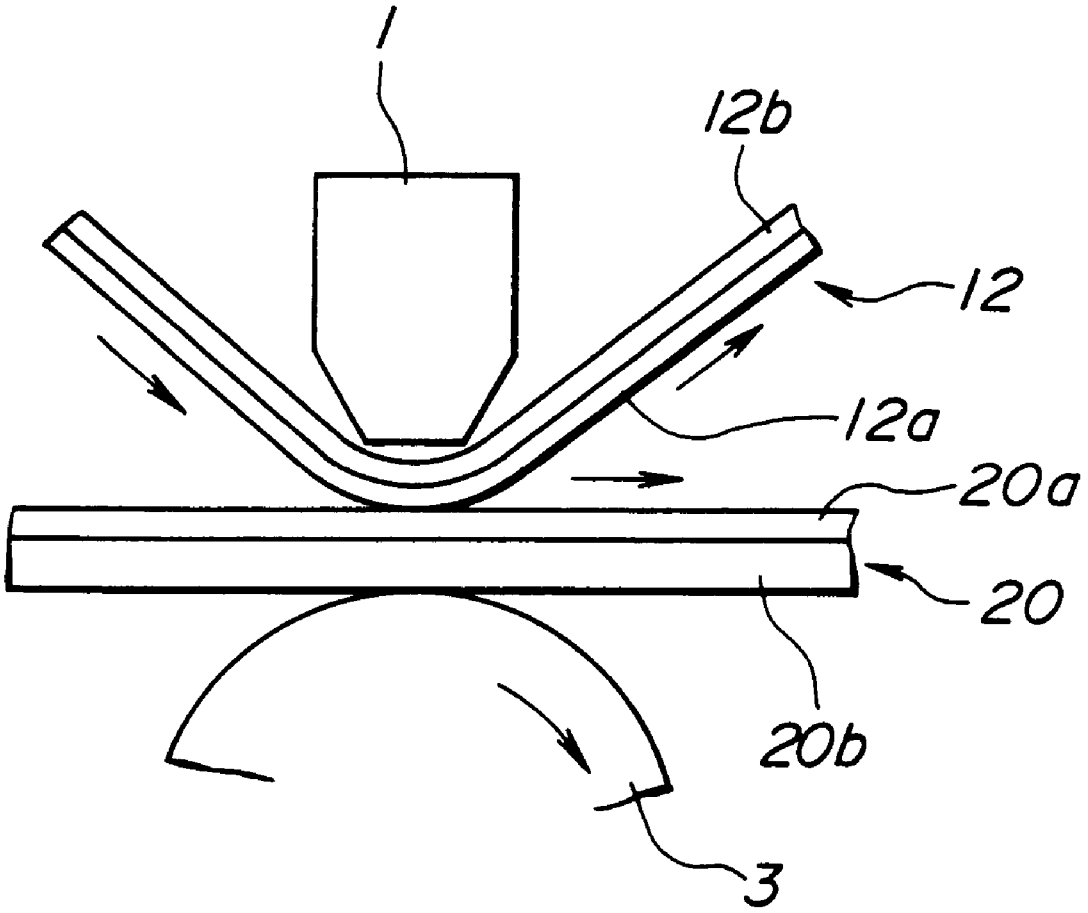
FIG. 1 (PRIOR ART)
FIG. 1 is a front view showing essential parts of a recording apparatus using a conventional thermal print head.

The thermal transfer recording material according to the present invention is introduced into a transfer section having a porous structure by an effect of capillarity, subjected to a state transformation such as vaporization or droplet formation and then transferred to a recording medium disposed in an opposed relation to the transfer section. The thermal transfer recording material contains a dye (cyan dye) represented by the general formula (I):

(I)

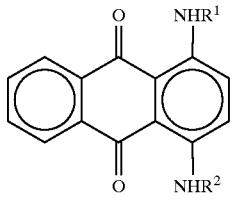

where $R^1$ and $R^2$ are individually a substituted or unsubstituted alkyl or alkenyl group, or a cycloalkyl group, and when both $R^1$ and $R^2$ are unsubstituted alkyl groups, at least one of $R^1$ and $R^2$ is a branched alkyl group.

The alkyl or alkenyl group represented by $R^1$ and $R^2$ in the general formula (I) may be a substituted or unsubstituted, linear or branched alkyl or alkenyl group having 1 to 13 carbon atoms.

In this case, examples of the substituted alkyl groups may include hydroxyl-substituted alkyl groups such as 2-hydroxyethyl, 3-hydroxypropyl, 4-hydroxybutyl or 2-hydroxypropyl, a phenyl-substituted alkyl group such as benzyl, p-chlorobenzyl or 2-phenylethyl, an alkoxy-substituted alkyl group such as 2-methoxyethyl, 2-ethoxyethyl, 2-(n)-propoxyethyl, 2-iso-propoxyethyl, 2-(n)-butoxyethyl, 2-iso-buthoxyethyl, 2-(2-ethylhexyloxy)-ethyl, 3-methoxypropyl, 2-methoxypropyl, 4-methoxybutyl or 3-methoxybutyl, 2,3-dimethoxypropyl or 2, 2-dimethoxyethyl, an alkoxy-alkoxy-substituted alkyl group such as 2-(2-methoxy-ethoxy)-ethyl, 2-(2-ethoxy-ethoxy)-ethyl, 2-(2-(n)-propoxy-ethoxy)-ethyl, 2-(2-(n)-butoxy-ethoxy)-ethyl or 2-{2-(2-ethylhexyloxy)-ethoxy}-ethyl, a substituted alkyl group such as 2-aryloxy-ethyl, 2-phenoxy-ethyl or 2-benzyloxy-ethyl, an acyloxy-substituted alkyl group such as 2-acetyloxy-ethyl, 2-propionyloxy-ethyl or 2-trifluoro-acetyloxy-ethyl, an alkoxycarbonyl-substituted alkyl group such as 2-methoxycarbonyl-ethyl or 2-ethoxy-carbonyl-ethyl, a heterocyclic group-substituted alkyl group such as furfuryl or tetrahydrofurfuryl, or the like.

The unsubstituted alkyl group as the radicals $R^1$ and $R^2$ may be a linear or branched alkyl group having no substituent. When the radicals $R^1$ and $R^2$ are an alkenyl group, examples thereof may include those having the same number of carbon atoms as the aforementioned alkyl group but at least one double bond.

The preferred cycloalkyl group represented by the radicals $R^1$ and $R^2$ may be cyclopentyl, cyclohexyl, or the like.

The particularly preferred radicals $R^1$ and $R^2$ may include a branched alkyl group having 1 to 8 carbon atoms, a linear or branched alkoxy group having 1 to 4 carbon atoms, a phenyl group, an aryloxy-substituted linear or branched alkyl group having 1 to 4 carbon atoms and a substituent group such as aryloxy, a heterocyclic group-substituted alkyl group (the heterocyclic group may include, for example, tetrahydrofurfuryl), an aryl-substituted alkenyl group having 2 to 8 carbon atoms, a cyclopentyl group, a cyclohexyl group, or the like.

Specific examples of the magenta dye represented by the general formula (I) are those enumerated in Table 1.

TABLE 1

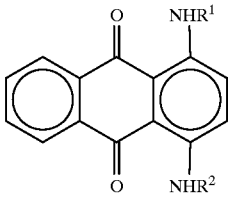

| PIGMENT No. | $R^1$ | $R^2$ | PIGMENT No. | $R^1$ | $R^2$ |
|---|---|---|---|---|---|
| 1 | $—C_3H_7(i)$ | $—C_3H_7(i)$ | 2 | $—C_4H_9(sec)$ | $—C_4H_9(sec)$ |
| 3 | $—C_4H_9(i)$ | $—C_4H_9(i)$ | 4 | $—CH(C_2H_5)_2$ | $—CH(C_2H_5)_2$ |
| 5 | $—CH\{C_3H_7(n)\}_2$ | $—CH\{C_3H_7(n)\}_2$ | 6 | $—CH_2CH_2OCH_3$ | $—CH_2CH_2OCH_3$ |
| 7 | 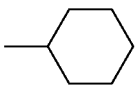 | 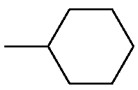 | 8 | 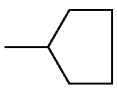 | 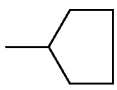 |
| 9 | $—CH_2CH_2OH$ | $—CH_2CH_2OH$ | 10 | $—CH_2—CH=CH_2$ | $—CH_2—CH=CH_2$ |

TABLE 1-continued

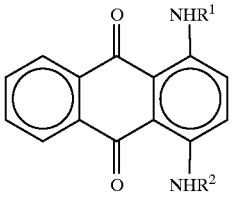

| PIGMENT No. | $R^1$ | $R^2$ | PIGMENT No. | $R^1$ | $R^2$ |
|---|---|---|---|---|---|
| 11 | $-C_3H_7(i)$ | $-CH_2-C_6H_5$ | 12 | $-C_3H_7(i)$ | $-CH_2CH(C_2H_5)C_6H_{13}(n)$ |
| 13 | $-C_3H_7(i)$ | $-CH_2CH_2OCH_3$ | 14 | $-C_3H_7(i)$ | $-CH_2CH_2OC_4H_9(n)$ |
| 15 | $-CH\{C_6H_{13}(n)\}_2$ | $-CH\{C_6H_{13}(n)\}_2$ | 16 | $-CH\{C_5H_{11}(n)\}_2$ | $-CH\{C_5H_{11}(n)\}_2$ |
| 17 | $-CH\{C_4H_9(n)\}_2$ | $-CH\{C_4H_9(n)\}_2$ | 18 | $-(CH_2)_3OCH_3$ | $-(CH_2)_3OCH_3$ |
| 19 | $-CH_2-$ 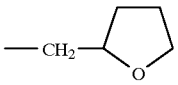 | $-CH_2-$ 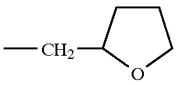 | 20 | $-CH_2CH_2O-C_6H_5$ | $-CH_2CH_2O-C_6H_5$ |
| 21 | $-CH_2CH_2OCH_2CH=CH_2$ | $-CH_2CH_2OCH_2CH=CH_2$ | 22 | $-C_3H_7(i)$ | $-CH_2CH_2OCOCH_3$ |
| 23 | $-C_3H_7(i)$ | $-CH_2CH_2COOC_2H_5$ | 24 | $-C_3H_7(i)$ | $-C_4H_9(i)$ |
| 25 | $-C_3H_7(i)$ | 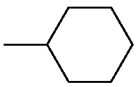 | 26 | $-C_3H_7(i)$ | 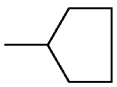 |
| 27 | $-C_3H_7(i)$ | $-CH(C_2H_5)_2$ | 28 | $-C_3H_7(i)$ | $-CH\{C_3H_7(n)\}_2$ |
| 29 | $-C_3H_7(i)$ | $-CH\{C_4H_9(n)\}_2$ | 30 | $-C_3H_7(i)$ | $-C_3H_7(n)$ |
| 31 | $-C_3H_7(i)$ | $-(CH_2CH_2O)_2C_2H_5$ | 32 | $-C_3H_7(i)$ | 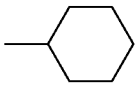 |
| 33 | $-CH(CH_3)C_3H_7(n)$ | $-CH(CH_3)C_3H_7(n)$ | | | |

Moreover, the thermal transfer recording material according to the present invention contains a dye (cyan dye) represented by the general formula (II):

(II)

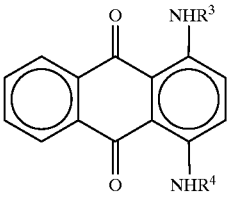

where $R^3$ and $R^4$ are individually a linear alkyl group, and at least one of $R^3$ and $R^4$ is an alkyl group having 5 or more carbon atoms.

Specific examples of the magenta dye represented by the general formula (II) are those enumerated in Table 2.

TABLE 2

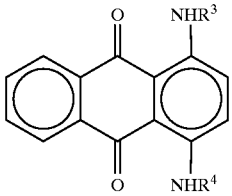

| PIGMENT No. | $R^3$ | $R^4$ | PIGMENT No. | $R^3$ | $R^4$ |
|---|---|---|---|---|---|
| 1 | $C_5H_{11}(n)$ | $C_5H_{11}(n)$ | 2 | $C_6H_{13}(n)$ | $C_6H_{13}(n)$ |
| 3 | $C_7H_{15}(n)$ | $C_7H_{15}(n)$ | 4 | $C_8H_{17}(n)$ | $C_8H_{17}(n)$ |
| 5 | $C_{12}H_{25}(n)$ | $C_{12}H_{25}(n)$ | 6 | $CH_3$ | $C_5H_{11}(n)$ |
| 7 | $CH_3$ | $C_6H_{13}(n)$ | 8 | $CH_3$ | $C_8H_{17}(n)$ |
| 9 | $CH_3$ | $C_{12}H_{25}(n)$ | 10 | $C_2H_5$ | $C_5H_{11}(n)$ |
| 11 | $C_2H_5$ | $C_6H_{13}(n)$ | 12 | $C_2H_5$ | $C_8H_{17}(n)$ |
| 13 | $C_2H_5$ | $C_{12}H_{25}(n)$ | 14 | $C_3H_7(n)$ | $C_5H_{11}(n)$ |

TABLE 2-continued

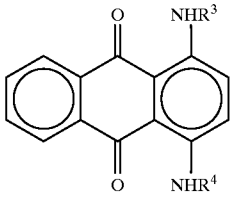

| PIGMENT No. | $R^3$ | $R^4$ | PIGMENT No. | $R^3$ | $R^4$ |
|---|---|---|---|---|---|
| 15 | $C_3H_7(n)$ | $C_6H_{13}(n)$ | 16 | $C_3H_7(n)$ | $C_8H_{17}(n)$ |
| 17 | $C_3H_7(n)$ | $C_{12}H_{25}(n)$ | 18 | $C_4H_9(n)$ | $C_5H_{11}(n)$ |
| 19 | $C_4H_9(n)$ | $C_6H_{13}(n)$ | 20 | $C_4H_9(n)$ | $C_8H_{17}(n)$ |
| 21 | $C_4H_9(n)$ | $C_{12}H_{25}(n)$ | 22 | $C_5H_{11}(n)$ | $C_6H_{13}(n)$ |
| 23 | $C_5H_{11}(n)$ | $C_8H_{17}(n)$ | 24 | $C_5H_{11}(n)$ | $C_{12}H_{25}(n)$ |
| 25 | $C_6H_{13}(n)$ | $C_8H_{17}(n)$ | 26 | $C_6H_{13}(n)$ | $C_{10}H_{21}(n)$ |
| 27 | $C_6H_{13}(n)$ | $C_{12}H_{25}(n)$ | 28 | $C_8H_{17}(n)$ | $C_{10}H_{21}(n)$ |
| 29 | $C_8H_{17}(n)$ | $C_{12}H_{25}(n)$ | | | |

Particularly, it is preferred that one of $R^3$ and $R^4$ is a linear alkyl group having 1 to 13 carbon atoms and the other is a linear group having 5 to 13 carbon atoms.

Concretely, the thermal transfer recording material according to the present invention is converted into vapor or mist having a diameter not more than 1 $\mu$m in a transfer section of a recording apparatus. The thus-produced vapor or mist is transferred through a gap of 10 $\mu$m to 300 $\mu$m onto a recording medium disposed in an opposed relation to the transfer section. Such a non-contact arrangement in which the transfer section is opposed through the gap to the recording medium, provides both a high quality image and a prompt printing operation, achieves compactness and light weight of the recording apparatus and enables the transfer of the dye to a plain paper without generation of wastes, whereby a low consumption of electric power and a low running cost can be realized.

The porous structure of the transfer section of the recording apparatus permits the thermal transfer recording material to be fed thereinto and retained therein by an effect of capillarity. Particularly, it is suitable that a pore of the porous structure has a side length or diameter of 0.2 to 3 $\mu$m. Moreover, it is preferred that the porous structure is so constructed that a plurality of small column-shaped members each having a side length or diameter of 0.2 $\mu$m to 3 $\mu$m and a height of 1 to 15 $\mu$m are arranged spaced at a distance of 0.3 $\mu$m to 3 $\mu$m apart from each other in three or more rows (in the longitudinal direction) and three or more columns (in the lateral direction).

By the provision of such a porous structure composed of a plurality of small column-shaped members, the following three remarkable effects are obtained.

That is, a first effect resides in that the aforementioned porous structure has a large surface area so that the thermal transfer recording liquid can be spontaneously fed into the transfer portion by an effect of capillarity.

A second effect resides in the following point. That is, a surface tension of a liquid is generally decreased as a temperature thereof is increased. As a result, when the recording liquid is heated, a heated center of the recording liquid has a low surface tension as compared with the surrounding portion thereof so that the heated center portion is forced outwardly. At this time, the center portion of the recording liquid is prohibited from moving outwardly due to the porous structure of the transfer section, whereby deterioration of transfer sensitivity of the heated center portion can be effectively prevented.

A third effect resides in that many pores of the transfer structure of the transfer section function as a fine nozzle opening for the recording liquid. As a result, an extremely large number of droplets composed of the finely divided recording liquid can be splashed or vaporized through a space between the transfer section and the recording medium, toward the recording medium such as a printing paper disposed in an opposed relation to the transfer section. By using this principal, it is possible to obtain a concentration gradation in the picture cell which cannot be achieved in the conventional ink-jet printing system.

That is, the provision of such a porous structure (irregular structure) on the transfer section permits the recording liquid to be continuously fed to the transfer section by an effect of capillarity and retained therein. In this condition, when the transfer section is selectively supplied with a quantity of heat in response to information data by an adequate heating means such as a thermal head or a laser beam, a part of the liquid recording material is evaporated and thereby causes a pressure rise. Successively, the heated recording liquid is converted into fine droplets whose volume is determined by a quantity of heat applied based on information data generated in the form of electrical signals from a color-video camera. The thus-produced fine droplets are then transferred to the recording medium so that a desired image is formed on the recording medium.

Accordingly, by using the recording apparatus having such a arrangement, there can be realized a thermal recording system capable of thermally transferring the recording liquid in the form of extremely fine droplets on demand so that an excellent ink-jet printing system can be provided, in which 128 or more concentration gradations can be expressed per at least one color.

Such a porous structure can be formed by using various methods. Such methods may include a method in which porous alumina layers each having an average particle size of 0.1 $\mu$m to 2 $\mu$m are arranged into a laminate having a thickness of 5 $\mu$m to 20 $\mu$m, a method in which glass beads having an average particle size of 0.5 $\mu$m to 3 $\mu$m are arranged into a laminate having 5 $\mu$m to 20 $\mu$m, a method in which a large number of silicon whiskers each having an average diameter of 0.5 $\mu$m to 2 $\mu$m and an average height of 2 $\mu$m to 10 $\mu$m are grown on a substrate at intervals of 1 $\mu$m to 3 $\mu$m, or the like methods.

It is preferred that the porous structure is formed from a plurality of small column-shaped members made of glass or silicon and each having a side length or diameter of 0.5 $\mu$m to 3 $\mu$m and a height of 1 $\mu$m to 15 $\mu$m. These small column-shaped members may be produced by semiconductor manufacturing techniques such as a reactive etching method (RIE), a powder beam etching method or the like, to perform an accurate control of, particularly, an amount of the recording liquid transferred. In this case, it is preferred that small column-shaped members are so arranged regularly spaced at a distance of 0.5 $\mu$m to 3 $\mu$m apart from each other as to form three or more rows (in the longitudinal direction) and three or more columns (in the lateral direction).

The porous structure may be in the form of walls, beads or fibers in addition to column-shaped members.

In addition, it is preferred that the porous structure has a heat resistance to an elevated temperature of 300° C. or higher.

In addition, although such a porous structure exhibits the aforementioned excellent advantages, when the recording operation is performed, particularly when it is repeated, there is a tendency that the porous structure with a fine pore size is likely to suffer from clogging due to adhesion of deteriorated materials such as decomposition products upon heating, whereby malfunctions of the print head occurs.

However, the dye accordance to the present invention, exhibits much enough heat resistance so that any kogation due to deposition of the decomposition products is not generated. As a result, even when the recording operation is repeated, the porous structure is still maintained and can function effectively.

In accordance with the present invention, the thermal transfer recording material according to the present invention may be composed of the hot melt-type dye represented by the general formula (I) or (II), singly. Alternatively, the thermal transfer recording material may be in the form of a solution or a liquid mixture containing the aforementioned dye uniformly dissolved or dispersed in a solvent other than water.

When the recording material is composed of the dye singly, a upstream side portion of the liquid flow path where the recording liquid is stored before being fed into the porous structure of the transfer section, for example, the recording liquid tank, must be heated to a temperature at which the recording material is in a molten state but never vaporized nor converted into droplets. Accordingly, the dye has, for example, a melting point of 160° C. or lower, preferably 120° C. or lower. Further, in order to subject the dye to a state transformation such as vaporization or droplet formation at the transfer section by heating, it is preferred that the dye has a vaporizing temperature ranging from 250° C. to 350° C.

Alternatively, when the recording material is used in the form of a liquid such as a solution or a dispersion, it is preferred that the recording material be composed of the aforementioned cyan dye which contains 90% by weight or more of a vaporizable component and 10% by weight or less of a residue when heated to a temperature of 300° C. or higher, and a non-aqueous solvent which has a boiling point of 150° C. or higher and can dissolve or disperse therein 5% by weight or more of the dye at 50° C. or lower.

As described above, the non-aqueous solvent used in the recording material is preferably capable of sufficiently dissolving or dispersing therein the aforementioned dye, and at the same time has a boiling point of 150° C. or higher. If the solvent has a boiling point less than 150° C., the solvent is easily vaporized or evaporated so that drying of the transfer section or fluctuation in concentration of the recording liquid is likely to occur. This would result in deterioration of a recording performance.

Particularly, the preferred solvent may be a colorless solvent having a melting point of 50° C. or lower and a boiling point ranging from 150° C. to 400° C. When the melting point of the solvent exceeds 50° C., the recording liquid prepared from a mixture of the dye and the solvent is likely to be condensed at the non-transfer temperature ranging generally from room temperature to 50° C. since the dye generally has a melting point of 100° C. or higher. Moreover, when the boiling point of the solvent exceeds 400° C., an efficiency of vaporization of the solvent is deteriorated whereby a transfer sensitivity of the recording system is apt to be decreased.

It is preferred that a molecular weight of the solvent is 450 or lower. When the molecular weight of the solvent is too high, the expansion coefficient becomes low upon vaporization of the solvent so that the transfer sensitivity is likely to be decreased. It is further preferred that the solvent contains 0.01% by weight or less of a residue when it is heated to 200° C. in air.

Moreover, in order to dissolve 5% by weight or higher, particularly 10% by weight or higher of the dye into the solvent at a temperature of 50° C. or lower, it is preferred that the solvent has a-solubility parameter (defined by J. H. Hildebrand) ranging from 7.5 to 10.5 at 25° C. When the solubility parameter of the solvent exceeds 10.5, a solubility of the dye is lowered and the recording liquid absorbs a moisture in air whereby the transfer sensitivity and reproductivity of the printed image are deteriorated. On the other hand, when the solubility parameter is less than 7.5, the solubility of the dye in the solvent is also likely to be decreased.

In addition, it is further preferred that the solvent is has a flash point of 150° C. or higher and a low toxicity to a human body.

Specific example of such a solvent may be an aromatic ester which may include dialkyl phthalates such as dimethyl phthalate, diethyl phthalate, dibutyl phthalate, di-iso-butyl phthalate or dioctyl phthalate. Moreover, desirable solvents may be aromatic hydrocarbons including n-alkyl benzene, n-alkyl naphthalene, n-dialkyl benzene, n-dialkyl naphthalene, or the like. These compounds may have an alkyl chain having 2 to 30 carbon atoms. The alkyl substituents of the aromatic hydrocarbons may include ethyl, isopropyl, dodecyl, or the like. In the case of n-alkyl benzene, the alkyl substituent may have 10 to 15 carbon atoms. Such n-alkyl benzene may include dodecyl benzene.

In addition, when the recording material is used in the liquid state such as the solution or the dispersion, an amount of the dye used is preferably in the range of 5 to 50% by weight, preferably 10 to 30% by weight, based on a total amount of the recording liquid. An amount of the solvent used may be the remainder of the recording liquid except the dye and additives which may be added thereto if desired. The amount of the solvent use may be generally in the range of 50 to 95% by weight based on the total weight of the recording liquid.

In the conventional ink-jet printing method, an acid dye is generally used as the dye because an aqueous recording material is used therein. Such an acid dye is oozed or flowed out on the recording paper after attached thereto. In consequence, the acid dye has a low water resistance and is difficult to be sufficiently color-developed. Further, when such an acid dye is used, there is a tendency to cause kogation due to a self-decomposition in case a heat is supplied thereto upon recording. On the other hand, the aforementioned particular dye according to the present invention does not cause such deficiencies due to its sufficient water resistance and therefore well attached to the recording paper and color-developed thereon. Further, the dye is unlikely to cause a kogation due to the deposition of the decomposition products.

Moreover, when the cyan dye is used in combination with, particularly, a phthalic acid-dialkyl ester, attachment of the cyan dye onto the recording paper is further improved because the solvent is well soaked into a fibrous structure of the recording paper such as plain paper copy (PPC) or an art paper. Further, the solvent also functions as a color-developing assistant. In consequence, when the recording liquid composed of the cyan dye and the solvent is used, the transfer of the dye to the plain paper such as a plain paper copy (PPC) or an art paper is attainable with a high quality image. Conventionally, a concentration of the dye in the recording liquid has been set to at most 5% by weight. On the other hand, the recording liquid composed, in combination, of the cyan dye and the solvent according to the present invention has as much large a solvent content as 10% by weight or higher so that a concentration of the printed image can be improved.

The thermal print head of a printer in which the recording material according to the present invention is employed, may comprise a transfer section (recording section) equipped with a heating means, an recording liquid storage tank for storing the recording material (molten dye or recording liquid), and a liquid passage communicating between the transfer section and the recording liquid storage tank. When the recording liquid composed of the solvent and the dye is used, such a thermal print head can be heated as a whole to about 50° C. to adjust a viscosity coefficient of the recording liquid to a proper level. In order to shorten a transfer time, two or more transfer sections can be provided on one thermal print head. The recording liquid is continuously fed to the transfer section through the recording liquid passage to compensate a quantity of the recording liquid consumed at the transfer section.

The heating means for heating the transfer section may include a heating member such as a resistance heater, a combination of a laser capable of varying its output depending upon the information data applied and a laser beam-absorbing material (light/heat transformer) provided at the transfer section, or the like. It is preferred that a semiconductor laser is used as the laser of the heating means because it has a high controllability and can constitute a compact and light-weight print head. The resistance heater can be prepared by attaching a conductive material such as polysilicon directly onto the transfer section.

The recording medium usable for the transfer of the recording liquid according to the present invention may include a plain paper such as PPC, a high quality paper such as an art paper or the like. Particularly, an exclusive printing paper prepared by coating a dye-developable resin such as a polyester, polycarbonate, acetate, an epoxy resin or polyvinyl chloride on a substrate paper can be usefully employed to obtain an image having a high concentration, an excellent gradation and a high quality. In order to assure a storage stability of the obtained image, it is effective to laminate a resin film on an image-carrying surface of the recording medium, after the transfer operation.

In order to obtain a multi-colored image (particularly full-colored image), three recording liquids respectively containing cyan, magenta and yellow color dyes in the three primary colors of a subtractive process, are separately prepared in the same manner. These recording liquids are transferred onto the recording medium by applying separate image signals indicative of yellow, magenta and cyan, to the respective transfer sections whereby the desired full-colored image can be obtained.

The preferred embodiments of the present invention are described in detail below by referring to the accompanying drawings. As is apparently appreciated, the embodiments are only illustrative and therefore it is not intended to limit the scope of the present invention thereto.

Referring to FIGS. 2 to 5, there is shown a non-contact-type thermal printer (for example; video printer) to which the thermal transfer recording material and method according to the present invention are applied.

In the thermal transfer recording system according to the present invention, as is shown in FIG. 1, the thermal print head 70 is heated by a laser beam. Further, a light-absorbing material (light/heat transformer) may be provided at a transfer section 57 to enhance an absorbance to the laser beam. In this case, when the recording material is composed of the cyan dye of the general formula (I) or (II) singly, the recording liquid storage tank 55 for storing the dye (liquefied dye; recording liquid 62) has to be heated to a temperature at which at least the dye is molten and liquefied, for example to a temperature of 80° C. to 160° C., by heating means such as heaters 56*a* and 56*b*. On the other hand, when the recording material is composed of the dye and the solvent, the heaters 56*a* and 56*b* may be used to heat the recording liquid 62 to a temperature of about 50° C. or lower whereby a viscosity of the recording liquid 62 is adjusted to a proper level.

In addition, a fine gap 51 is formed between the print head 70 and a recording medium 80 opposed to the print head.

By using an adequate heating means such as a laser L, a portion of the liquid dye (recording liquid) 62 in the transfer section is selectively heated so that the heated portion of the recording liquid is converted into vapor or fine droplets which are then splashed or vaporized through the fine gap 51 toward the recording medium 80 to form an image having a continuous gradation thereon. This operation is repeated with respect to respective image signals for yellow, magenta and cyan of the three primary colors of a subtractive process so that a full-colored image can be obtained on the recording medium.

The fine gap 51 is preferably in the range of 10 $\mu$m to 300 $\mu$m, more preferably 50 $\mu$m to 200 $\mu$m. When the gap 51 is less than 10 $\mu$m, the thermal print head 70 is likely to come into contact with the recording medium 80 during movement of the print head whereby a stability of the image transfer is apt to be undesirably lowered. On the other hand, when the gap 51 is more than 300 $\mu$m, the vapor or the fine droplets cannot reach the recording medium 80 in an effective manner so that a sensitivity of the image transfer and a resolution of the image is apt to be deteriorated.

In the thermal transfer recording system according to the present invention, the recording medium 80 may be disposed, for example, above the thermal print head 70 in an opposed manner. The laser beam L emitted from a laser 18 is condensed through a lens 19 and irradiated on a portion in proximity of an upper surface of the transfer section 57 to convert the irradiated portion of the recording material into vapor or fine droplets, whereby the vapor or fine droplets 82 of the recording material can be splashed or vaporized in an upward direction.

In addition, a recording liquid storage tank 55 can be provided in a laser beam-permeable head base 54. The liquefied dye (recording liquid) 62 is stored in a space between a bottom surface of the recording liquid storage tank 55 and a spacer 58 fixed on the head base 54 and continuously fed from the space to the transfer section 57 through the liquid passage 67. In this case, a plurality of small column-shaped members 61 having porous structure is provided at the transfer section 57. Such small column-shaped members 61 can be prepared by using a reactive ion etching method (RIE) or lithographic techniques.

These small column-shaped members 61 exhibits a heat resistance to an elevated temperature of 300° C. or higher, and has a height of 1 $\mu$m to 15 $\mu$m, preferably 2 $\mu$m to 10 $\mu$m and a diameter or side length (t) of 0.2 $\mu$m to 3 $\mu$m, preferably 0.5 $\mu$m to 3 $\mu$m. A distance d between the adjacent small column-shaped members is in the range of 0.2 $\mu$m to 3 $\mu$m, preferably 0.5 $\mu$m to 3 $\mu$m. The small column-shaped members have a circular or rectangular shape in section. It is preferred that the small column-shaped members are regularly arranged in juxtaposed relation in three or more rows (longitudinal direction) and three or more columns (lateral direction). (see FIGS. 3 and 4)

Since the small column-shaped members having the porous structure has a large surface area, the recording liquid is caused to be spontaneously introduced into the transfer section (vaporizing section) due to an effect of capillarity. In such a column-shaped member structure, even though the center portion of the transfer section is locally heated upon the transfer operation, it is prevented to cause an undesired phenomenon that the recording liquid is caused to move to a non-heated portion of the transfer section due to its temperature dependency (escape phenomenon).

In this case, when the height of each small column-shaped member 61 is less than 1 $\mu$m or the distance between adjacent small column-shaped members exceeds 3 $\mu$m, it is difficult to prevent the aforementioned escape phenomenon of the recording liquid upon the transfer operation. On the other hand, when the height of the small column-shaped member exceeds 15 $\mu$m, a quantity of the recording liquid retained therein is too large so that it becomes difficult to effectively heat the recording liquid 62. When the small column-shaped member 61 has a diameter or side length less than 0.2 $\mu$m, the small column-shaped members 61 are likely to be broken by a wave motion of the recording liquid which generates upon heating. On the other hand, when the diameter or side length of the small column-shaped member 61 exceeds 3 $\mu$m or the distance between the adjacent small column-shaped members 61 less than 0.2 $\mu$m, an amount of the recording liquid in the transfer section becomes too small so that the transfer sensitivity is apt to be lowered.

Figure 4:
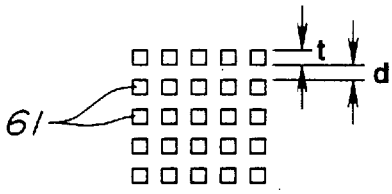
FIG. 4 is a plan view showing a pattern of a group of small column-shaped members provided at a transfer section (vaporization section) of the thermal print head according to the first embodiment of the present invention.

A shape of a top plan surface of the small column-shaped member 61 may be a square as shown in FIG. 4, or the other adequate shape. Further, an aggregate of the small column-shaped members may be arranged in a matrix composed of 2 to 100 rows in the longitudinal direction and 2 to 100 columns in the lateral direction.

Figure 2:
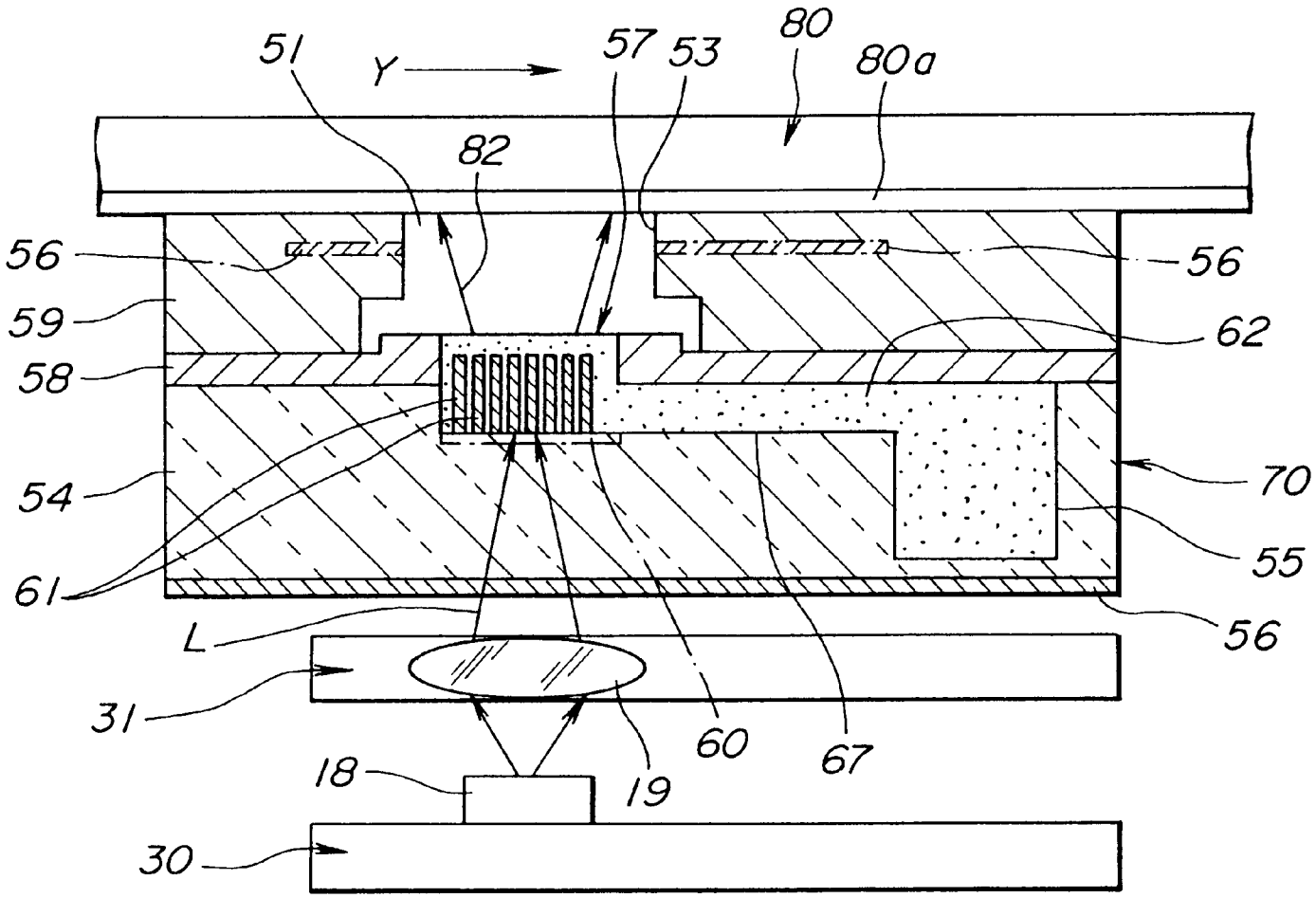
FIG. 2 is a sectional view of a thermal print head according to a first embodiment of the present invention.
Figure 3:
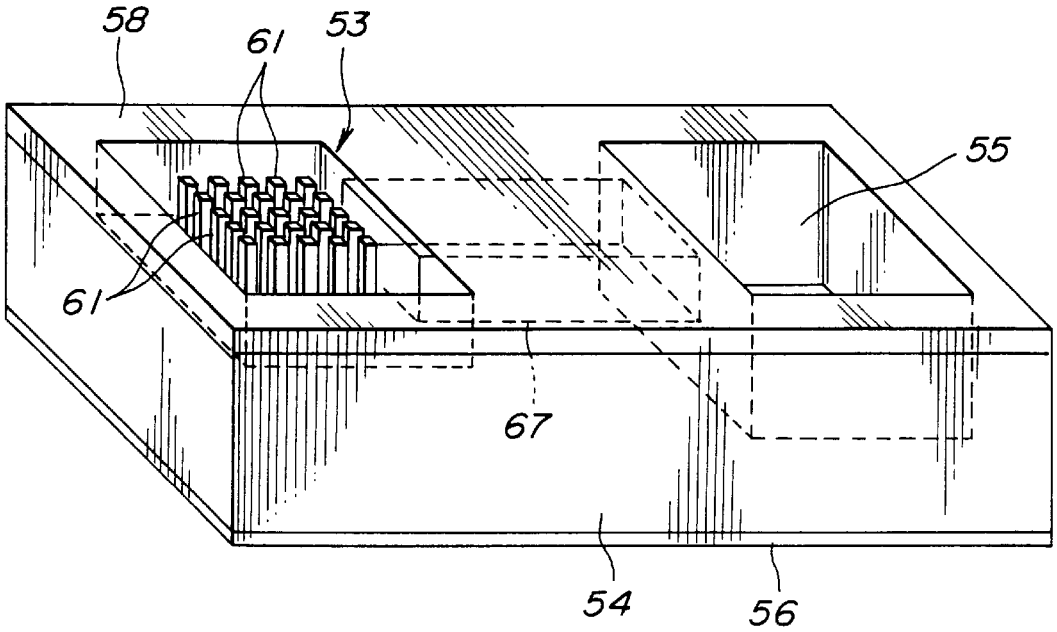
FIG. 3 is a perspective view showing essential parts of the thermal print head according to the first embodiment of the present invention.

On the spacer 58 of the thermal print head, there is fixedly provided a protective plate 59 which defines the gap 51 and serves as a guide for traveling the recording paper 80 in the direction as indicated by x in FIG. 2 whereby the recording paper is fed into or discharged from the transfer section. The protective plate 59 may be provided therein with a heating means to retain a liquid state of the fused dye and the recording liquid. The heating means may include the heater element **56*b* buried in the head base as indicated by a phantom line in FIG. 2, Alternatively, as indicated by a solid line in FIG. 2, only the heater element 56*a* may be fixed on an outer surface of the head base 54. Further, both the heater elements 56*a* and 56*b* may be provided to heat the recording material 62. Moreover, the other heater elements can be provided in the liquid passage 67 or the recording liquid storage tank 55**.

In the thermal print head 70 of the present invention, the head base 54 may be made of an inorganic material having a high heat resistance, such as glass, metal, silicon, ceramic or the like, or an organic polymer having a heat resistance to an elevated temperature of 300° C. or higher, such as polyimide, aramide or the like. The thermal print head 70 can be provided with an adequate thermal insulating device to permit a recording liquid 62 having a melting point higher than room temperature to be used therein.

The liquid passage 67, which serves for feeding the recording liquid 62 from the recording liquid storage tank 55 to the transfer section 57, may have a sectional surface area of 50 $\mu m^2$ or more to permit a rapid supply of the recording liquid 62 having a viscosity coefficient of 10 cps or lower at 150° C. or lower to be fed to the transfer section, whereby deterioration of the transfer sensitivity does not occur during the transfer operation.

The dyes usable in the recording liquid 62 according to the present invention may include those represented by the aforementioned general formula (I) or (II). Such a dye may be used singly or in the form of a mixture of two or more different compounds.

The recording liquid 62 is partially heated and vaporized to form a vapor or fine droplets containing an amount of the dye in response to information data entered. The thus-produced vapor or fine droplets are splashed or vaporized through the gap 51 to transfer it on the recording medium 80. In the case of the ink-jet printing system, a volume of the vapor or fine droplets is expanded 50 or higher times that of the original volume of the recording liquid 62 upon vaporization thereof. It is preferred that the aforementioned recording liquid 62 is prepared by dispersing the dye in the solvent (carrier) having a melting point of 50° C. or lower and a boiling point of 150° C. or higher, preferably in the range of 250 to 400° C. at one atm. Especially, the preferred solvent is dialkyl phthalate.

The recording medium (recording paper) suitably used to receive the recording material 62 according to the preferred embodiment of the present invention, may be provided thereon with a dye-acceptor layer 80*a*. Any recording medium can be used in the present invention as far as it has an adequate compatibility to the dye represented by the general formula (I) or (II) and the dye is easily accepted thereon so as to promote an inherent color development and surely effect the fixing thereof on the recording medium.

As is shown in FIG. 2, when the laser beam is used as the heating means for heating the transfer section, a resolution of the transferred image is considerably enhanced. Further, since a density of the laser beam can be increased by using an optical system, a heating of the thermal print head 70 can be performed in a concentrated manner so that the temperature of the thermal print head 70 is considerably elevated whereby a thermal coefficient of the recording system is improved.

Particularly, by using a semiconductor multi-laser having a structure in which several to several hundred semiconductor-laser elements are arranged in line, the transfer time per one print image is considerably shortened. However, since the laser beam is continuously irradiated, the light/heat transformer as indicated by a dotted line 60 in FIG. 2 must have a sufficient heat resistance.

Accordingly, such a light/heat transformer 60 suitably used in the present invention may include a metal thin film having an absorbency to an emission wave length of the laser beam, or a two-thin layer-type light absorber composed of a metal thin film and a ceramic film having a high dielectric constant. The light/heat transformer 60 can be directly fixed on the transfer section as shown in FIG. 2. Alternatively, a particulate light-absorber composed of fine particles such as carbon black, metal powder or the like can be uniformly dispersed in the recording material 62.

Moreover, an entire body of the thermal print head 70 is so constituted that, for example when full-colored recording is contemplated, recording liquid storage tanks 55C, 55M and 55Y for respective cyan-, magenta- and yellow-color dyes can be provided in a common head base 54 and communicate with separate print heads 70C, 70M and 70Y to introduce respective recording liquids into the transfer sections 57C, 57M and 57Y each composed of a plurality of dot arrays arranged in 12 to 24 rows.

At a position opposed to respective transfer sections 57C, 57M and 57Y, there are provided multi-laser arrays 30 composed of laser elements 18 (particularly semiconductor laser chips), for example, twenty-four (24) laser elements arranged in the form of an array. Each of the laser beams emitted from the multi-laser array 30 is condensed through a micro-lens array 31 composed of a plurality of condensing lens 19.

Incidentally, in the case of mono-color printing in which the cyan dye according to the present invention is used solely, it is sufficient to provide a single print head 70 on the head base 54, together with a corresponding one-dimensional laser array.

The porous structure of the transfer section 57 of the print head 70 accommodates the recording liquid 62 in such a manner that the recording liquid 62 forms a dot pattern corresponding to the number of recording dots. The laser elements 18 are also arranged in the form of an array so as to have an emission points corresponding to the number of the recording dots.

The printer equipped with the aforementioned printer head 70 may be operated, for example, in a serial-type printing mode in which the recording medium (paper) 80 is fed in the longitudinal direction (X direction) and the printer head 70 is scanned in the lateral direction (Y direction perpendicular to X direction). The feeding of the recording medium 80 in the longitudinal direction and the scanning of the print head 70 in the lateral direction may be carried out in an alternate manner.

Figure 5:
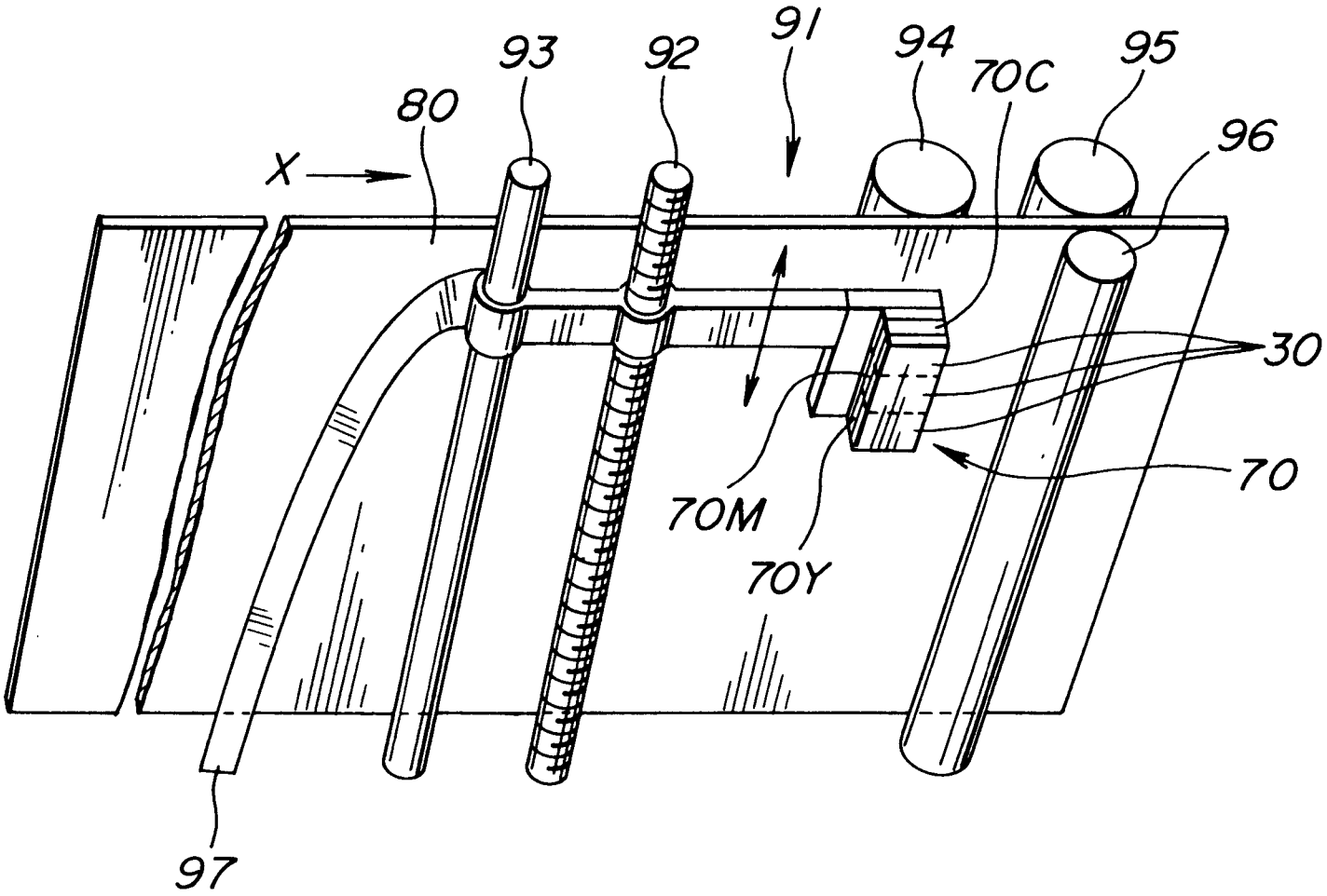
FIG. 5 is a perspective view schematically showing a printer as viewed from a lower side thereof, in which the thermal print head according to the first embodiment of the present invention is incorporated.

As shown in FIG. 5, the printer 91 includes, for example, a multi-color print head 70. The print head 70 is caused to reciprocatively move in the Y direction perpendicular to the X direction (feed direction of the recording medium 80) by means of a head feeding shaft 92 and a head support shaft 93 both constituted by a feed screw mechanism.

Rotatably disposed above the print head 70 is a head receiving roller 94 for supporting the recording medium 80 in a sandwiched manner. The recording medium 80 is then interposed between a drive roller 95 and a driven roller 96 to be delivered in the X direction.

Incidentally, the print head 70 is electrically connected through a flexible harness 97 to a head drive circuit board (not shown) or the like.

EXAMPLES

In the following, the present invention is described in more detail by way of examples and comparative examples.

Example 1

A recording liquid composed of the dye No. 1 of Table 1 was filled into a thermal transfer print head as shown in FIG. 2, which was provided with a transfer section having a size of 50 μm and small column-shaped members having a diameter of 2 μm, while heating an entire part of the print head to 100° C. The thermal transfer print head was mounted to a printer as shown in FIG. 5, which had a single head segment for a mono-color printing. Further, an exclusive recording paper (VPM30STA manufactured by Sony Corp.) for a sublimation-type thermal transfer printing was set on the printer. At this time, a distance between the recording paper and the transfer print head was adjusted to 50 μm.

Next, a laser beam emitted from a semiconductor laser and having a wave length of 850 nm was condensed through an optical system to the transfer section to form a spot of 6 μm×10 μm on the transfer section. Laser pulses of "1 ms ON" and "1 ms OFF" at 20 mW were irradiated to the transfer section, and at the same time the recording paper was scanned to form a line image thereon. As a result, there was obtained a cyan-colored line image having a width of about 80 μm and an optical density (OD; measured by Mcbeth reflection densitometer) of about 0.4.

In addition, after one million laser pulses were irradiated, the thermal print head was removed from the printer and then washed to remove a residual dye. The transfer section of the print head was then observed by a microscope. As a result, it was confirmed that no trace of burnt deposits was present.

Example 2

The procedure of Example 1 was repeated in the same manner as described above except that the dye No. 2 of Table 1 was used instead of the dye No. 1. As a result, it was confirmed that no trace of burnt deposits was present even after application of one million laser pulses.

Example 3

The procedure of Example 1 was repeated in the same manner as described above except that the dye No. 3 of Table 1 was used instead of the dye No. 1. As a result, it was confirmed that no trace of burnt deposits was present even after application of one million laser pulses.

Example 4

The procedure of Example 1 was repeated in the same manner as described above except that the dye No. 4 of Table 1 was used instead of the dye No. 1. As a result, it was confirmed that no trace of burnt deposits was present even after application of one million laser pulses.

Example 5

The procedure of Example 1 was repeated in the same manner as described above except that the dye No. 5 of Table 1 was used instead of the dye No. 1. As a result, it was confirmed that no trace of burnt deposits was present even after application of one million laser pulses.

Example 6

The procedure of Example 1 was repeated in the same manner as described above except that the dye No. 6 of Table 1 was used instead of the dye No. 1. As a result, it was confirmed that no trace of burnt deposits was present even after application of one million laser pulses.

Example 7

The dye No. 1 of Table 1 was dissolved in dimethyl phthalate to prepare a recording liquid having a dye concentration of 15% by weight. The thus-prepared recording liquid was filled into the transfer print head at a normal temperature. Subsequent procedures were performed in the same manner as in Example 1. As a result, there was obtained a line image having a width of 80 $\mu$m and an optical density (OD) of about 0.1. Further, it was confirmed that no trace of burnt deposits was present even after application of one million laser pulses.

Comparative Example 1

The procedure of Example 1 was repeated in the same manner as described above except the dye having the following general formula was used instead of the dye No. 1.

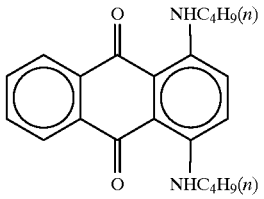

As a result, when the number of applied laser pulses exceeded about 100,000, an amount of the recording liquid transferred was reduced so that a concentration of the printed line image started to be decreased. When the number of applied laser pulses reached 200,000, it was impossible to continue the transfer printing operation. The print head was removed from the printer and washed to remove the residual dye. The print head was observed by using a microscope so that it was confirmed that burnt deposits were generated on a head portion of the small column-shaped members.

Comparative Example 2

The procedure of Example 7 was repeated in the same manner as described above except the dye used in the above Comparative Example 1 was used instead of the dye No. 1 of Table 1. As a result, when the number of applied laser pulses exceeded about 100,000, an amount of the recording liquid transferred was reduced so that a concentration of the printed line image started to be decreased. When the number of applied laser pulses reached 200,000, it was impossible to continue the transfer printing operation. The print head was removed from the printer and washed to remove the residual dye. The print head was observed by using a microscope so that it was confirmed that burnt deposits were attached on a head portion of the small column-shaped members.

Example 8

A recording liquid composed of the dye No. 1 of Table 2 was filled into the thermal transfer print head 70 as shown in FIG. 2, which was provided with the transfer section having a size of 50 $\mu$m and small column-shaped members having a diameter of 2 $\mu$m, while heating an entire part of the print head 70 to 100° C. by using the heater element 56*a*. The thermal transfer print head 70 was mounted to a printer as shown in FIG. 5, which had a single head segment for a mono-color printing. Further, an exclusive recording paper (VPM30STA manufactured by Sony Corp.) as the recording medium 80 for a sublimation-type thermal transfer printing was set on the printer. At this time, a distance between the recording paper and the transfer section 57 of the print head was adjusted to 50 $\mu$m.

Next, a laser beam emitted from a semiconductor laser and having a wave length of 850 nm was condensed through an optical system to the transfer section 57 to form a spot of 6 $\mu$m×10 $\mu$m on the transfer section 57. Laser pulses of "1 ms ON" and "1 ms OFF" at 20 mW were irradiated to the transfer section 57, and at the same time the recording medium 80 was scanned to form a line image thereon. As a result, there was obtained a cyan-colored line image having a width of about 80 $\mu$m and an optical density (OD; measured by Mcbeth reflection densitometer) of about 0.4.

In addition, after one million laser pulses were irradiated, the thermal print head 70 was removed from the printer and then washed to remove a residual dye. The transfer section 57 of the print head was then observed by using a microscope. As a result, it was confirmed that no trace of burnt deposits was present.

Example 9

The procedure of Example 8 was repeated in the same manner as described above except that the dye No. 2 of Table 2 was used instead of the dye No. 1 of Table 2. As a result, it was confirmed that no trace of burnt deposits was present even after application of one million laser pulses.

Example 10

The procedure of Example 8 was repeated in the same manner as described above except that the dye No. 3 of Table 2 was used instead of the dye No. 1 of Table 2. As a result, it was confirmed that no trace of burnt deposits was present even after application of one million laser pulses.

Example 11

The procedure of Example 8 was repeated in the same manner as described above except that the dye No. 4 of Table 2 was used instead of the dye No. 1 of Table 2. As a result, it was confirmed that no trace of burnt deposits was present even after application of one million laser pulses.

Example 12

The procedure of Example 8 was repeated in the same manner as described above except that the dye No. 5 of Table 2 was used instead of the dye No. 1 of Table 2. As a result, it was confirmed that no trace of burnt deposits was present even after application of one million laser pulses.

Example 13

The procedure of Example 8 was repeated in the same manner as described above except that the dye No. 6 of Table 2 was used instead of the dye No. 1 of Table 2. As a result, it was confirmed that no trace of burnt deposits was present even after application of one million laser pulses.

Example 14

The dye No. 1 of Table 2 was dissolved in dimethyl phthalate to prepare a recording liquid 62 having a dye concentration of 15% by weight. The thus-prepared recording liquid 62 was filled into the transfer section 57 of the transfer print head at a normal temperature. Subsequent procedures were performed in the same manner as in Example 8. As a result, there was obtained a line image having a width of 80 $\mu$m and an optical density (OD) of about 0.1. Further, it was confirmed that no trace of burnt deposits was present even after application of one million laser pulses.

In the thermal transfer recording method according to the present invention, since the transfer section of the print head has the porous structure, a large number of fine droplets of the recording material can be produced. Further, the number of droplets can be freely controlled by applying a heating energy corresponding to information data entered to the transfer section. This enables a multi-valued concentration gradation which results in obtaining, for example, a full-colored printed image having an image quality identical to or higher than that by a silver salt-type recording system if the cyan-colored dye is used in combination with the dyes exhibiting other colors.

In addition, by using the thermal transfer recording system according to the present invention, compactness of the printer, ease of maintenance, prompt printing operation, and high quality and high gradation of printed images can be achieved.

As described above, in accordance with the present invention, the recording material contains the dye of the aforementioned general formula (I) or (II), so that it shows a sufficient heat resistance, whereby no kogation due to decomposition products occurs. As a result, the porous structure of the transfer section in the print head and its function can be maintained even when subjected to repeated recording operations.

Thus, since the thermal transfer recording method according to the present invention has the features of not only the thermal transfer recording system but also the ink-jet printing system, no disposable ink ribbons or sheets is required and a transfer energy needed for the transfer operation can be considerably saved. Further, compactness and weight-reduction of the recording apparatus, an excellent resolution and a high concentration gradation of the image in the dots can be achieved without deficiencies such as a kogation due to the decomposition products. This results in maintaining a good recording performance of the recording system for a long period of time.

Although the present invention is described with respect to the preferred embodiments, it will be apparently understood that the present invention is not intended to be limited to those particular embodiments and that various changes and modifications could be effected without departing from the spirit or scope of the invention.

What is claimed is:

1. A thermal transfer recording method used in operation of a recording apparatus including a transfer section having a porous structure, comprising the steps of:

introducing, into said transfer section by capillary forces, a thermal transfer recording fluid containing a dye represented by the general formula (I):

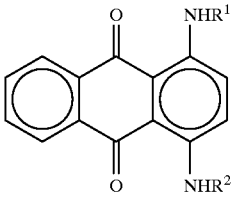

where $R^1$ and $R^2$ are individually a substituted or unsubstituted alkyl or alkenyl group, or a cycloalkyl group, and when both $R^1$ and $R^2$ are unsubstituted alkyl groups, at least one of $R^1$ and $R^2$ is a branched alkyl group, the thermal transfer recording fluid further comprising a solvent;

subjecting said thermal transfer recording fluid to a state transformation by heating as the thermal transfer fluid is drawn through the transfer section under said capillary forces, the transfer section comprising a plurality of column-shaped members having a diameter ranging from 0.2 $\mu$m to 3 $\mu$m and a height ranging from 1 $\mu$m to 15 $\mu$m, the columns being spaced apart by a distance ranging from 0.3 $\mu$m to 3 $\mu$m and wherein said thermal transfer recording fluid is in a liquid state prior to entering the transfer section and converted into a gas or a mist in the transfer section; and transferring said gas or mist across a gap to a recording medium disposed in an opposing relationship to said transfer section.

2. The thermal transfer recording method according to claim 1, wherein said gas or mist having a droplet size of not more than 1 μm upon heating, said gas or mist being transferred to said recording medium across the gap, the gap having a length ranging from 10 μm to 300 μm.

3. The thermal transfer recording method according to claim 1, wherein said column-shaped members being arranged in three or more columns and three or more rows at intervals of 0.5 to 3 μm.

4. The thermal transfer recording method according to claim 1, wherein said recording fluid is colorless and has a molecular weight not more than 450, a melting point not higher than 50° C. and a boiling point ranging from 150° C. to 400° C., and composed of a solution dissolving 5% by weight or more of the dye of the general formula (I) in the solvent at 50° C. or lower, said solvent generating a residue in an amount of 0.01% by weight or less when heated to 200° C. in air.

5. The thermal transfer recording method according to claim 4, wherein said solvent is an aromatic ester and/or an aromatic hydrocarbon.

6. The thermal transfer recording method according to claim 5, wherein said solvent is dialkyl phthalate.

7. A thermal transfer recording method used in operation of a recording apparatus including a transfer section having a porous structure, comprising the steps of:

introducing, into said transfer section by capillary forces, a thermal transfer recording liquid containing a dye represented by the general formula (II):

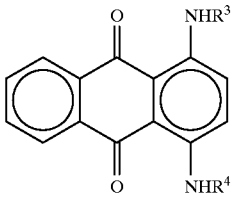

where $R^3$ and $R^4$ are individually a linear alkyl group, and at least one of $R^3$ and $R^4$ is an alkyl group having 5 or more carbon atoms said recording liquid further comprising a solvent;

subjecting said thermal transfer recording liquid to a state transformation by heating in the transfer section, the transfer section comprising a plurality of column-shaped members having a diameter ranging from 0.2 μm to 3 μm and a height ranging from 1 μm to 15 um, the columns being spaced apart by a distance ranging from 0.3 μm to 3 μm wherein said recording liquid is converted into a gas or a mist in the transfer section; and transferring said gas or mist across a gap to a recording medium disposed in an opposing relationship to said transfer section.

8. The thermal transfer recording method according to claim 7, wherein said gas or mist having a droplet size of not more than 1 μm upon exiting said transfer section, said gas or mist being transferred to said recording medium across the gap, the gap having a length ranging from 10 μm to 300 μm.

9. The thermal transfer recording method according to claim 7, wherein said column-shaped members being arranged in three or more columns and three or more roews at intervals of 0.5 to 3 m.

10. The thermal transfer recording method according to claim 7, wherein said recording fluid is colorless and has a molecular weight not more than 450, a melting point not higher than 50° C. and a boiling point ranging from 150° C. to 400° C., and composed of a solution dissolving 5% by weight or more of the dye of the general formula (II) in the solvent at 50° C. or lower, said solvent generating a residue in an amount of 0.01% by weight or less when heated to 200° C. in air.

11. The thermal transfer recording method according to claim 10, wherein said solvent is an aromatic ester and/or an aromatic hydrocarbon.

12. The thermal transfer recording method according to claim 11, wherein said solvent is dialkyl phthalate.

* * * * *